US005174781A

United States Patent [19]

Muzslay

[11] Patent Number: 5,174,781

[45] Date of Patent: Dec. 29, 1992

[54] CONNECTOR BAIL LATCH

[75] Inventor: Steven Z. Muzslay, Huntington Beach, Calif.

[73] Assignee: ITT Corporation, Secaucus, N.J.

[21] Appl. No.: 876,991

[22] Filed: May 1, 1992

[51] Int. Cl.[5] ..... H01R 13/62

[52] U.S. Cl. ..... 439/372; 437/370

[58] Field of Search ..... 439/369-373, 439/366, 345, 799; 403/330, 238; 285/320

[56] References Cited

U.S. PATENT DOCUMENTS

| | | | |
|---|---|---|---|
| 1,568,995 | 1/1926 | Benjamin . | |
| 1,844,916 | 2/1932 | Dykes . | |
| 1,925,716 | 9/1933 | D'Olier, Jr. | 173/322 |
| 2,190,230 | 2/1940 | Cole | 173/343 |
| 2,389,895 | 11/1945 | Colley et al. | 174/21 |
| 2,487,801 | 11/1949 | Healy, Jr. | 439/369 |
| 2,916,720 | 12/1959 | Steans | 339/91 |
| 3,017,598 | 1/1962 | Low | 439/371 |
| 3,643,204 | 2/1972 | Drenten | 339/17 |

FOREIGN PATENT DOCUMENTS

| | | | |
|---|---|---|---|
| 568027 | 12/1958 | Canada . | |
| 0328701 | 11/1920 | Fed. Rep. of Germany | 439/372 |
| 667957 | 11/1938 | Fed. Rep. of Germany . | |

*Primary Examiner*—Larry I. Schwartz
*Assistant Examiner*—Hien D. Vu
*Attorney, Agent, or Firm*—Thomas L. Peterson

[57] ABSTRACT

First and second connectors are provided, wherein when the connectors are mated a wire bail on the first connector is pivoted to a position over the second connector, which more securely retains the bail and facilitates its release. The bail (20B, FIG. 1) has arms (22, 24) with lower ends (30) forming shaft parts received in holes in the first connector housing. Accidental pullout of the shaft parts is prevented by a bail retainer (60) that lies beyond the shaft part and prevents it from pulling out except when the bail is in an open position (20A) wherein a crossleg (26) at its top lies beyond an end (44) of the first connector. The top of the second connector includes latch and stop walls (36, 38) that form a recess (34) therebetween which receives the crossleg of the bail. The latch wall forming a laterally-extending ramp (100). When the bail in its closed position is twisted so its crossleg (at 26A in FIG. 7) extends at an angle (A) from the lateral position, the crossleg can advance up the ramp (100) to clear the latch wall and move to the open position.

12 Claims, 3 Drawing Sheets

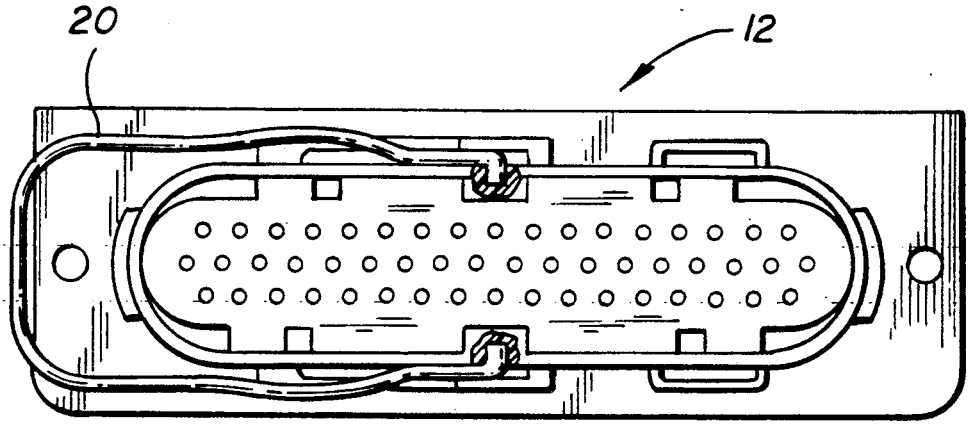
FIG. 5
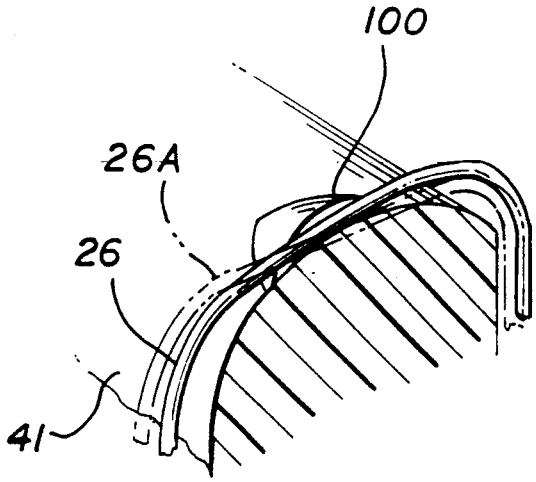
FIG. 6
FIG. 7
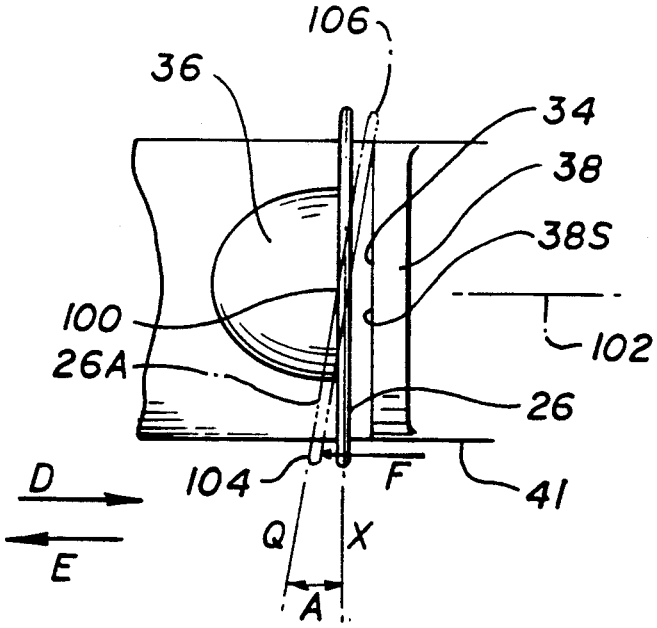

CONNECTOR BAIL LATCH

BACKGROUND OF THE INVENTION

Mated connectors are often secured together by the use of a bail in the form of a wire extending in a largely 180° loop, the bail having a pair of vertical arms whose upper ends are connected by a crossleg. The lower ends of the arms are bent towards each other to form shaft parts that are pivotally mounted in the lower connector. The pivotal mounting allows the bail to pivot to a closed position wherein the crossleg lies over the upper connector to hold it down. The shaft parts of prior bails can be easily pulled out even when the bail is being used to secure the connectors together. The closed bail can be easily opened by moving the crossleg across a latch wall on the top of the upper connector, which increases the possibility of accidental opening. Before the connectors are mated, the bail may have pivoted away from the open position and far past the closed position, so that once the connectors are mated, the bail cannot be pivoted backward to the closed position. Instead, the connectors must be unmated, the bail pivoted to the open position, and the connectors remated before the bail can be closed. Connectors which were constructed to avoid the above problems in a simple construction, would be of considerable value.

SUMMARY OF THE INVENTION

In accordance with one embodiment of the present invention, a connector system is provided which includes a bail for holding a pair of mated connectors together, which holds the bail securely to one connector, facilitates opening of the bail, and assures that the bail can be readily closed once the connectors are mated. The system includes first and second connectors, wherein the first connector includes a bail having a pair of arms with lower ends forming shaft parts that extend into holes of the first connector housing, the upper ends of the arms being connected by a crossleg which can ride over the top of the second connector to prevent it from lifting off the first connector after the connectors are mated. The first connector has a pair of bail retainers that each forms a retainer passage which allows one of the arms to pivot between closed and open positions, but which prevents the lower arm end from moving away from a corresponding side of the first connector housing. The passage wall prevents the pivot part of the bail arm from moving out of the hole in the connector housing, to thereby prevent loss of the bail in the closed position of the bail.

The second connector has latch and stop walls forming a recess between them, which receives the crossleg of the bail in its closed position. The latch wall forms a ramp extending in a lateral direction. When a person presses on one side of the bail, to twist it so the crossleg extends at an angle from the lateral direction, the crossleg can ride up the ramp to move over the latch wall and thereafter move to the open position. At least one bail retainer forms a stop wall that limits pivoting of the bail past the closed position, so that if the bail is not in an open position it at least lies in the path of connector mating.

The novel features of the invention are set forth with particularity in the appended claims. The invention will be best understood from the following description when read in conjunction with the accompanying drawings.

BRIEF DESCRIPTION OF THE DRAWINGS

FIG. 5 is a plan view of the lower connector of the connector system of FIG. 1.

FIG. 6 is a partial view of the connector system of FIG. 1, showing how the bail can be twisted to move it away from the closed position.

FIG. 7 is a partial plan view of the connector system of FIG. 6.

DESCRIPTION OF THE PREFERRED EMBODIMENT

Figure 1:
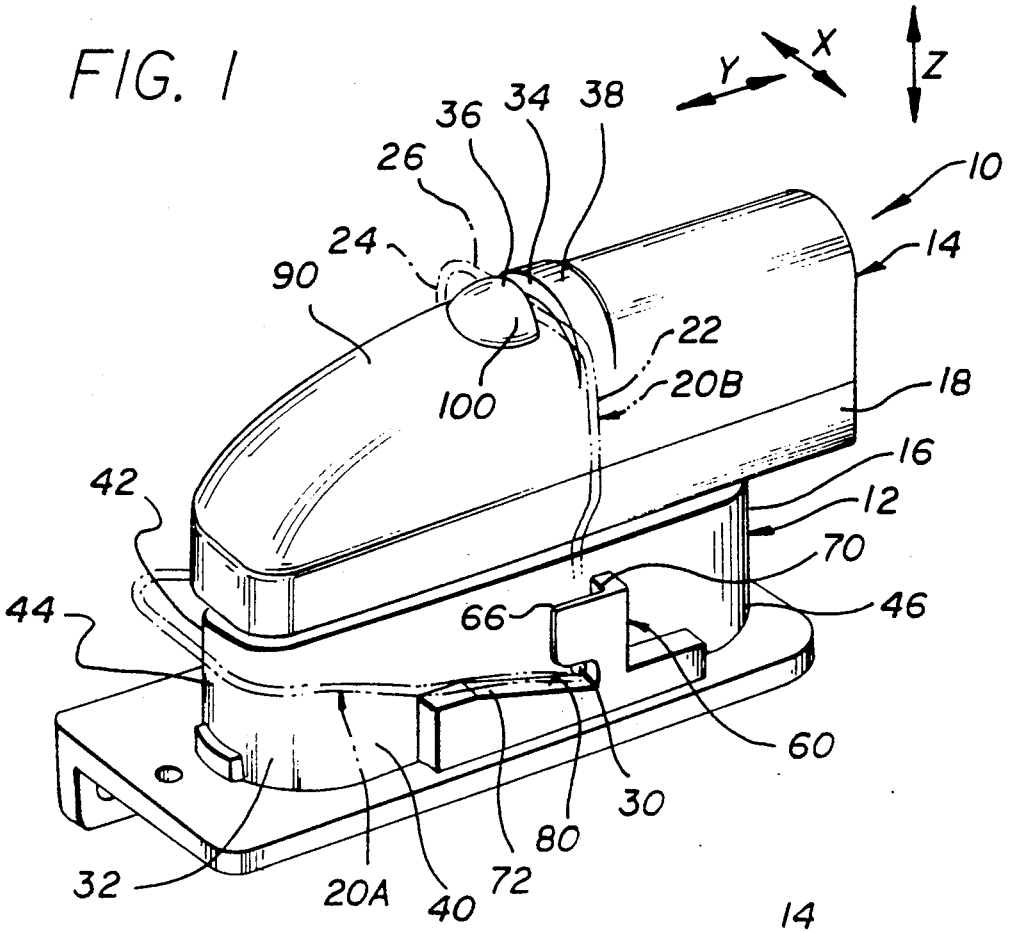
FIG. 1 is an isometric view of a connector system constructed in accordance with the present invention, showing first and second connectors in a fully mated position, and showing, in phantom lines, the bail in both the open and closed positions.

FIG. 1 illustrates a connector system 10 of the present invention which includes first and second connectors 12, 14, with the first connector having an upper part 16 mated with the lower part 18 of the second connector or connector device 14. The lower connector includes a wire bail indicated at 20A in the open position, and at 20B in the closed position. The bail is used to secure the two connectors together after they have been mated. The bail has a pair of arms 22, 24 which extend largely vertically in the closed position, with the upper ends of the arm joined by a crossleg 26. Each bail arm has a lower end or end portion 30 (relative to the vertical bail position 20B) which is pivotally mounted on the housing 32 of the first or lower connector 12. When the bail is in the open position 20A, wherein it extends largely horizontally, the connectors can be moved vertically to mate and unmate. When the bail is in the closed position 20B, its crossleg 26 lies in a recess 34 formed between a latch wall 36 and a stop wall 38 formed on the second connector. The bail must ride over the latch wall 36 in moving to or away from the closed position. The first connector 12 has first and second opposite sides 40, 42 that are spaced apart in a lateral direction X, and has first and second opposite ends 44, 46 that are spaced apart in a perpendicular longitudinal direction Y, with both direction X, Y being perpendicular to the vertical direction Z. It should be noted that while terms such as "vertical", "upper", "lower", etc. are used herein to aid in the description of the parts as shown in the drawings, the connectors can be used in any orientation with respect to gravity.

Figure 4:
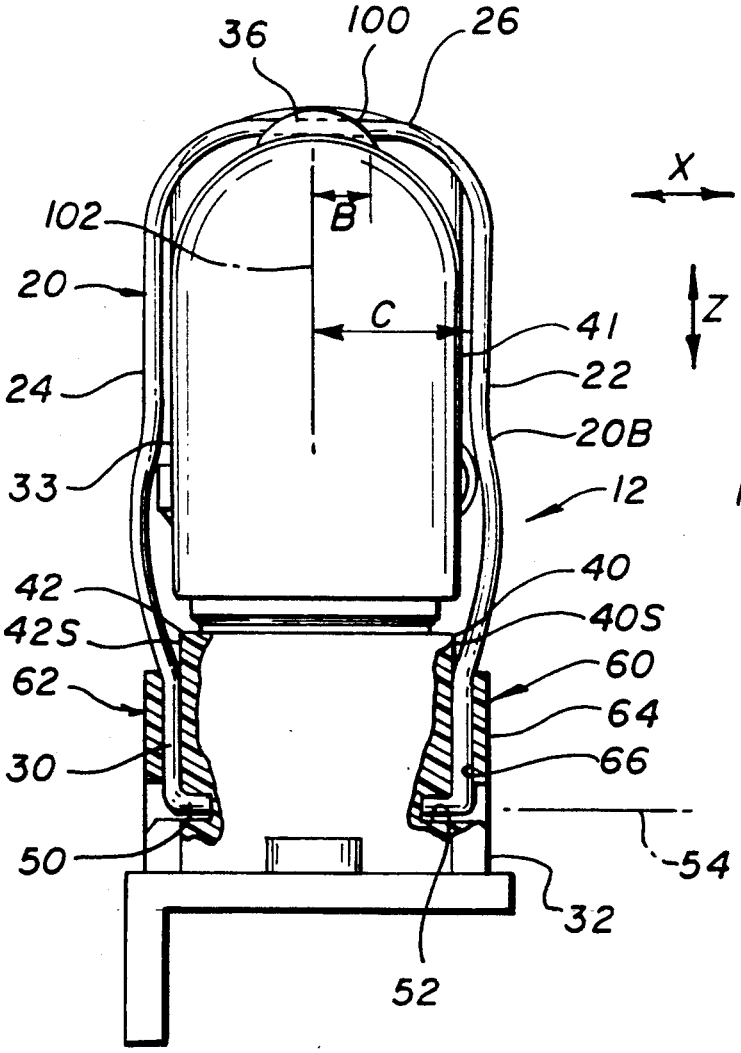
FIG. 4 is an end elevation, and partially sectional view of the connector system of FIG. 1.

As shown in FIG. 4, the arms 22, 24 of the bail lie beside the opposite side surfaces 40*s*, 42*s* of the housing sides 40, 42. The lower end 30 of each bail arm forms a shaft part 50 that is received in a corresponding shaft-receiving hole 52 of the connector housing. The shaft parts 50 lie substantially on a bail pivot axis 54 about which the bail can pivot between its open and closed positions.

The connector 12 has a pair of bail retainers 60, 62, each lying at a different one of the housing sides 40, 42 and being formed integrally with the plastic molded housing. Each retainer such as 60 includes a retainer wall 64 laterally spaced from a corresponding housing side surface 40s to leave a retainer passage 66 between them. Each of the arms can slidably move along a corresponding retainer passage 66 during pivoting about the pivot axis 54. The retainer wall 64 lies close to the adjacent side surface 40s so that the retainer passage 66 is narrow. The retainer passage 66 is narrow enough to prevent a corresponding shaft part 50 from pulling completely out of a corresponding shaft-receiving hole 52. That is, the retainer prevents the corresponding shaft part 50 from moving in a lateral direction out of the shaft-receiving hole. As a result, when the retainer is near its closed position, when large forces may be applied in moving it to or from the closed position, the bail retainer 60 prevents accidental pullout of the bail from a corresponding shaft-receiving hole 52, to more securely keep the bail in place. It may be noted that it is possible to flatten the lower ends of the arms and form holes therein, and to provide the connector housing with shafts that extend into the holes, which is the equivalent of the illustrated arrangement. In either case, the bail retainers 60 prevent disconnection of the bail.

Figure 2:
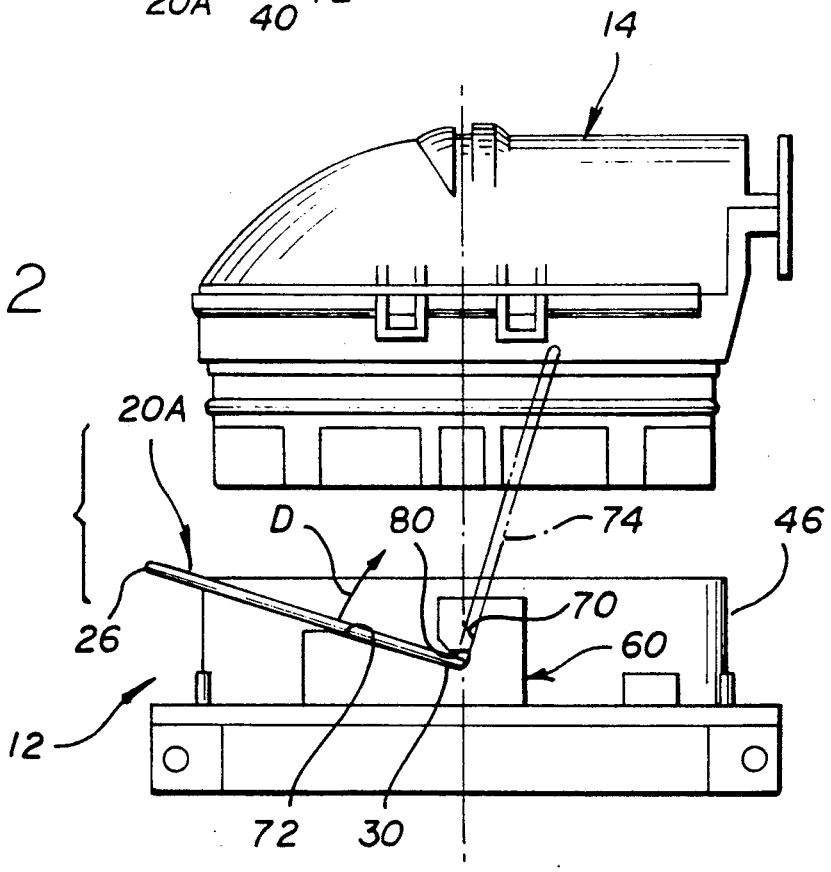
FIG. 2 is a side elevation view of the connector system of FIG. 1, showing the connectors unmated and showing, in solid lines, the bail in the open position.

As shown in FIGS. 1 and 2, the bail retainer forms open and far stops 70, 72 that limit bail pivoting. When the first connector 12 is not mated to the second connector 14, the bail 20 can pivot in the clockwise direction shown at D in FIG. 2, beyond the closed position to a far position 74. The far stop 70 prevents any further pivoting. In the absence of the far stop 70, the bail 20 could pivot until its crossleg lay beyond the second end 46 of the first connector. This would allow the connectors 12, 14 to be mated, but with the bail in a position that prevented it from pivoting to the closed position. With the bail limited by the far stop 70, a person assembling the connectors can see that the bail is in the wrong position, and will pivot the bail to its open position before attempting to mate the connectors. The person does not have to waste time after mating the connectors, to unmate them, return the bail to its open position, and again mate the connectors before moving the bail to the closed position.

The bail retainer 60 has a mounting slot 80 which is in line with the bail arm lower end 30 only when the bail is near or in the open position 20A. This enables installation of the bail on the connector 12 by spreading apart its lower ends and fitting the shaft parts 50 into the shaft-receiving holes 52. The open position stop 72 prevents pivoting of the bail in a direction opposite the direction D so far that the bail crossleg 26 could pivot down and around to the other side 46 of the connector. Actually, applicant prefers to locate the open position stop 72 so the bail is just out of the way of mating of the connectors.

Figure 3:
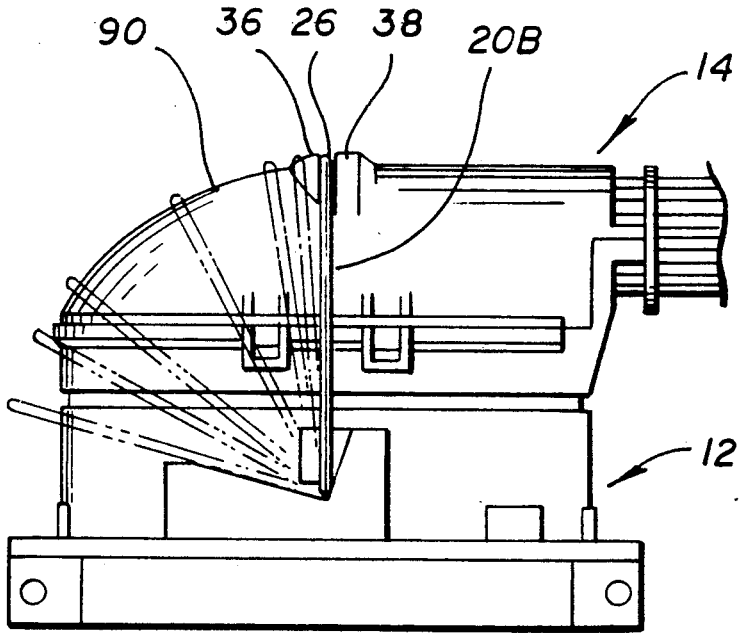
FIG. 3 is a view similar to FIG. 2, but with the connectors fully mated and the solid lines showing the bail in the closed position.

As shown in FIG. 3, the second connector 14 has a curved forward-upward surface portion 90 which the bail crossleg 26 passes across in movement between its open and closed positions. The surface portion 90 is curved to substantially follow the curved path of the bail crossleg. This has the advantage that the bail also serves to assure that the connectors are fully mated before an attempt is made to move the bail over the latch wall 36 to the fully closed position 20B.

As shown in FIG. 7, when the leg 26 is in the fully closed position, it tends to extend substantially in the lateral direction X and is trapped in the recess 34 between the latch wall 36 and the stop wall 38. While the crossleg 26 is intended to never pass across the stop wall 38, it must pass in both closing and opening directions D, E across the latch wall 36. Referring to FIG. 4, the crossleg 26 can be bent upwardly to pass across the latch wall 36, but it would require a large effort to upwardly deflect the middle of the crossleg 26 by more than a small amount. To facilitate movement of the crossleg toward the open position, across the latch wall 36, applicant constructs the latch wall so it forms a ramp 100. The ramp 100 extends in a downward-lateral direction towards an adjacent side 41 of the second connector housing 33, and away from a longitudinally-extending center plane 102 of the connectors.

As shown in FIG. 7, the bail can be easily twisted so the crossleg 26 is pivoted from extension in the lateral direction X to a direction Q which is at an angle A to the lateral direction X. This allows the angled crossleg 26A to ride up the ramp 100 formed at the top of the latch wall 36 as a largely longitudinal force F is applied to one side 104 of the upper part of the bail. The ramp 100 deflects the middle of the crossleg 26 upwardly until the crossleg passes across the top of the ramp 100, after which the bail can be readily moved in the direction E towards the open position. The connector 12 and bail 20 are substantially symmetrical about the longitudinally extending center plane 102, so the bail can be released from the closed position by pushing against either side of the bail near its upper end.

As shown in FIG. 4, applicant prefers to provide a ramp 100 of a length B which is much less than the distance C between the plane 102 and a corresponding arm 22 of the bail. This short distance B results in twist of the bail causing locations near the center of the crossleg 26 to engage the ramp. Locations near the middle of the crossleg are easier to deflect upwardly. In addition, when the crossleg is angled as shown at 26A in FIG. 7, and the middle of the crossleg starts to climb up the ramp 100, such climbing is enhanced by the fact that the opposite side 106 of the twisted bail crossleg tends to press against the surface 38s of the stop wall so the crossleg acts somewhat like a lever pivoting about its end 106. The fact that the bail can be twisted to ride over the ramp to unlatch it, enables the top of the latch wall 26 to lie slightly higher. This provides more secure holding of the bail in its closed position. Perhaps an even more important result, is that as the bail is moved from the open position to the closed position, then as it passes the latch wall 36 it provides a definite "snap" action and a "click" noise indicating that the bail has reached its closed position.

Thus, the invention provides a connector system of the type which uses a bail to hold a pair of mated connectors securely together, which securely retains the bail, facilitates unlatching the bail from its fully closed position, and prevents the bail from moving so far beyond the closed position that it could not be pivoted to the closed position after the connectors mate. A pair of bail retainers lie at opposite sides of a connector on which the bail pivots, the retainers forming retainer walls that leave passages in which the retainer arms can move in pivoting but which prevent pullout of the arms from holes in the connector housing. The second connector or connector device, has a latch wall over which a crossleg of the bail must pass when moving to or away from the closed position. The latch wall forms a ramp, and the crossleg can ride up the ramp when the bail is twisted. The bail retainer forms a far stop that limits pivoting of the bail away from the open position, to prevent the cross arm from lying at an end of the connector housing opposite the end it lies at in the open position, to thereby assure that the bail can be moved to the closed position after the connectors are mated.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector system which includes a first connector which has an upper part that can mate with a second connector, wherein each connector has a housing with longitudinally spaced ends and with laterally-spaced opposite sides, with first connector opposite sides forming shaft-receiving holes, and said first connector includes a wire bail with opposite arms lying beside its connector sides, wherein said arms have upper ends connected by a crossleg of said bail and said arms have lower ends forming shaft parts extending laterally into said holes to pivotably mount said bail on said housing about a pivot axis, to enable said bail to pivot between a closed position wherein said crossleg lies over said second connector when mated to said first connector and an open position wherein said crossleg lies substantially beyond a first of said housing ends, characterized by:

said connector housing sides each includes a housing side surface and a bail retainer, with each bail retainer having a retainer wall laterally spaced from said side surface to leave a retainer passage therebetween along which one of said arms moves during bail pivoting about said shaft parts when said bail is in said closed position, with said retainer wall lying close enough to said housing side surface to prevent a corresponding shaft part from moving laterally completely out of a corresponding shaft-receiving hole.

2. The connector system described in claim 1 wherein:

said second connector has an upper part that includes longitudinally-spaced latch and stop walls forming a bail-receiving recess between them that receives said bail crossleg when said connectors are mated and said bail is in said closed position, with said latch wall being positioned so said base part passes over said latch wall during movement away from said open position toward said closed position;

said latch wall forming a ramp extending in a downward lateral direction toward an adjacent one of said second connector sides, and said bail being twistable to orient said crossleg to extend it at angle to said lateral direction, so said crossleg can ride up along said ramp away from said locked position toward said open position.

3. The connector described in claim 1 wherein:

a first of said bail retainers forms a far stop that is positioned to abut a corresponding one of said bail arms to limit the angle of bail pivoting away from said open position to a bail position at least as far as said closed position, which assures that when said arm abuts said far stop said crossleg lies in the way of said second connector mating with said first connector.

4. The connector describe in claim 1 wherein:

one of said bail retainers forms an open position stop that abuts one of said bail arms in said open position of said bail, to prevent bail pivoting further than said open position away from said closed position.

5. The connector system described in claim 1 wherein:

said upper part of said second connector has a surface portion which said crossarm passes over in movement toward said closed position, said surface portion being curved to follow the path of said crossarm, as viewed along said pivot axis.

6. A connector system, comprising:

first and second mateable connectors, each having a housing with upper and lower parts, longitudinally spaced opposite ends, and laterally-spaced opposite sides, said connectors being constructed so the upper part of said first connector mates with the lower part of said second connector;

said first connector including a bail having opposite arms with upper and lower ends, with said arms lying at said opposite sides of said first connector housing, said bail having a crossleg extending in said lateral direction and connecting said upper arm ends, and each bail lower end being pivotally mounted on said first connector housing to enable said bail to be pivoted between an open position wherein said crossleg lies at a first of said ends of said first connector housing and a closed positions.

said second connector housing upper part having latch and stop walls forming a laterally-extending recess therebetween for receiving said crossleg when said bail is in said closed position, said latch wall located so said base passes over it during movement toward said closed position, and said stop wall located to prevent movement of said base away from said open position past said closed position;

said latch wall forming a ramp surface extending in a downward-lateral direction toward an adjacent one of said second connector sides, and said bail being twistable to orient said crossleg at an angle to said lateral direction so said crossleg can ride up along said ramp away from said closed position toward said open position.

7. The connector described in claim 6 wherein:

at least a first of said sides of said first connector has a wall forming a far stop positioned to abut one of said bail arms to limit the angle of bail pivoting away from said open position to a bail position at which said crossleg lies in the path of said second connector during its movement toward said first connector to mate therewith.

8. The connector described in claim 6 wherein:

said second connector has a longitudinal middle plane that lies halfway between said second connector opposite sides;

when said connectors are mated, said ramp surface extends above the height of said bail leg along a lateral distance B away from said center plane, which is no more than half the lateral distance between said middle plane and a corresponding one of said second connector sides.

9. The connector system described in claim 6 wherein:

each of said bail arm lower ends can be detached from said first connector housing by pulling the arm lower end away from the housing, and said opposite sides of said first connector housing each has a side surface and a bail retainer that includes a retainer wall spaced from said side surface to leave a retainer passage therebetween along which one of said bail arm lower ends can move during bail movement near said closed position, with said retainer wall lying close enough to said side wall to prevent a corresponding arm lower end from moving completely out of pivotal connection with said first connector housing when said bail arm lies in said passage.

10. The connector system described in claim 9 wherein:

said retainer wall is constructed so when said bail is in said open position, said arms are unobstructed in lateral movement by said retainer wall to thereby allow said shaft parts to move laterally into and to be pulled laterally apart and out of said shaft-receiving holes.

11. A method for constructing, latching, and unlatching first and second connectors that each have a housing with laterally spaced sides and a longitudinal center plane lying halfway between said opposite sides, wherein said first connector housing includes an upper part that mates with a lower part of said second connector, and said first connector has a wire bail with arms comprising upper arm ends joined by a crossleg and lower arms ends pivotally mounted about a laterally-extending axis on said first connector housing, wherein said second connector has an upper part forming spaced latch and stop walls forming a recess between them which receives said bail crossleg, characterized by:

forming said latch wall so it forms a ramp that extends downwardly and away from said center plane toward a first side of said second connector housing;

unlatching said bail when said crossleg lies in said recess, by twisting said bail so said crossleg extends at an angle of a plurality of degrees from said lateral direction and moving said crossleg up along said ramp until said crossleg passes said latch wall.

12. The method described in claim 11 wherein:

said step of twisting said bail and moving said crossleg up along said ramp, includes pushing against said bail only against a location substantially where the upper end of a first of said arms merges with one end of said crossleg, to move said one end of said crossleg away from said stop wall.

* * * * *